US008561534B2

(12) United States Patent
Fenzi

(10) Patent No.: US 8,561,534 B2
(45) Date of Patent: Oct. 22, 2013

(54) DECORATING AN ELONGATED ELEMENT

(71) Applicant: Decoral System USA Corp., Coral Springs, FL (US)

(72) Inventor: Giancarlo Fenzi, Illasi (IT)

(73) Assignee: Decoral System USA Corp., Coral Springs, FL (US)

( * ) Notice: Subject to any disclaimer, the term of this patent is extended or adjusted under 35 U.S.C. 154(b) by 0 days.

(21) Appl. No.: 13/869,425

(22) Filed: Apr. 24, 2013

(65) Prior Publication Data

US 2013/0233188 A1 Sep. 12, 2013

Related U.S. Application Data

(63) Continuation of application No. 11/385,823, filed on Mar. 22, 2006, now abandoned.

(30) Foreign Application Priority Data

Jun. 29, 2005 (IT) ..... MO2005A0167

(51) Int. Cl.
*B41F 17/00* (2006.01)

(52) U.S. Cl.
USPC ..... 101/36; 101/35; 101/37; 101/424.1

(58) Field of Classification Search
USPC ..... 101/35, 36, 37, 155, 157, 169, 350.5, 101/350.6
See application file for complete search history.

(56) References Cited

U.S. PATENT DOCUMENTS

| | | | | |
|---|---|---|---|---|
| 3,352,741 | A * | 11/1967 | Miller | 428/160 |
| 3,736,870 | A * | 6/1973 | Johnson et al. | 101/329 |
| 4,738,134 | A * | 4/1988 | Hauer et al. | 73/149 |
| 5,289,767 | A * | 3/1994 | Montalto et al. | 101/35 |
| 5,444,466 | A * | 8/1995 | Smyczek et al. | 347/4 |
| 5,757,389 | A | 5/1998 | Schwede et al. | |
| 6,817,287 | B2 * | 11/2004 | Shadrach, III | 101/35 |
| 6,843,172 | B2 * | 1/2005 | Polloni et al. | 101/35 |
| 2001/0049010 | A1 | 12/2001 | Fenzi | |

FOREIGN PATENT DOCUMENTS

| | | |
|---|---|---|
| GB | 906669 | 9/1962 |
| WO | 98/53992 | 12/1998 |
| WO | 02/11897 | 2/2002 |
| WO | 2004/069559 | 8/2004 |

* cited by examiner

*Primary Examiner* — Ren Yan
(74) *Attorney, Agent, or Firm* — Lucas & Mercanti, LLP

(57) ABSTRACT

A decorating apparatus comprises an advancing arrangement for advancing an elongated element in an advancing direction substantially parallel to the longitudinal axis of the elongated element and a plurality of decorating devices positioned downstream one another along the advancing arrangement for decorating distinct surfaces of said elongated element, each decorating device comprising a decorating unit for decorating a respective surface of the elongated element, the decorating unit comprising:

a transferring device for transferring a flowable material on the elongated element, including a transferring roller rotatable around a rotation axis and arranged for interacting with the elongated element, the transferring roller being made of deformable material so that non-flat surfaces can be decorated;

a kiln arrangement arranged downstream of the transferring device for heating said flowable material applied to said elongated element.

18 Claims, 10 Drawing Sheets

DECORATING AN ELONGATED ELEMENT

This application is a continuation of U.S. patent application Ser. No. 11/385,823 filed on Mar. 22, 2006 which claims priority to and the benefit of Italian Application No. MO2005A000167 filed on Jun. 29, 2005, the contents of which are incorporated herein by reference in their entirety.

The invention relates to apparatuses and methods for decorating a surface of an elongated element, in particular a section bar or a metal sheet that are usable in the building industry.

Apparatuses and methods are known that enable a decorative layer obtained with a decorative ink hardenable by ultraviolet rays or UV ink or through a sublimation process to be applied to a surface of a section bar.

In particular, these apparatuses and methods enable a plane surface or a shaped surface of even complicated geometry of the section bar element to be decorated for example having a curved profile or having grooves, or protruberances or recesses) or edge zones of the section bar.

The section bar can be decorated with any decorative pattern: for example with patterns reproducing the appearance of a wood or marble surface or of any other natural material.

According to these methods, after first applying a bottom layer to the section bar that will constitute the base colour of the decoration, the decorative layer has to be placed on the section bar.

If the decorative layer has been made with a UV ink, apparatuses are known comprising a supplying roller and a decorating roller that cooperate for decorating the section bar.

In particular, the decorating roller has a smooth external surface, whereas the supplying roller is provided with a surface on which a pattern is engraved that it is desired to transfer to the section bar.

This pattern can be defined by a plurality of cavities obtained on the supplying roller and in this case the latter operates according to a principle of intaglio printing, or by a plurality of raised parts obtained on the supplying roller, that operates according to a principle of relief printing.

In known apparatuses, the UV ink, that is arranged according to a desired pattern, is transferred from the supplying roller to the decorating roller that applies the UV ink on a surface of the section bar facing the decorating roller.

A drawback of the known apparatuses and methods is the excessive process time required for decorating a section bar and the consequent increase in production costs.

In fact, once a first surface of the section bar has been decorated, it is necessary, if it is desired to decorate a second surface of the latter, to pick up the section bar from the apparatus, rotate the section bar and again reposition the section bar in the apparatus.

It is obvious that this operation is particularly laborious if it is desired to decorate all the surfaces of the section bar.

Furthermore, to rotate the section bar and reinsert the section bar into the apparatus, suitable moving devices are required that contribute to further increasing production costs.

Furthermore, when the section bar is rotated and/or is reinserted into the apparatus, the section bar may accidentally knock objects, damaging already decorated surfaces.

Lastly, the UV inks may not have ideal adhesion to the section bar for particularly hard uses, detaching themselves from the latter relatively easily.

In order to limit this last drawback and improve the adhesion between the decorative layer and the section bar, the section bars can be decorated through the sublimation process.

This process provides for using a transferring support made of paper or film on which a decorative pattern is printed by means of sublimable inks to be applied to the section bar. The latter is wrapped in the transferring support so as to define around the section bar a tubular casing that is open at the ends.

Air is then sucked from the ends of the tubular casing so as to make the transferring support adhere to the section bar and the latter is introduced into a kiln.

In this way, owing to the pressure exerted by the transferring support and owing to the kiln temperature, the decorative pattern sublimes, i.e. passes directly from solid state to gaseous state and transfers from the transferring support to the section bar, on which the decorative patternpasses again to the solid state.

By using the sublimation process, it is possible to obtain decorations that have good adhesion to the section bar inasmuch as the sublimable inks penetrate a surface layer of the section bar to which the sublimable inks firmly fix themselves.

Nevertheless, the apparatuses and methods for decorating section bars through sublimation are particularly complicated inasmuch as they require complex devices, for example suking devices for sucking the air inside the tubular casing.

Furthermore, the known apparatuses are not cheap inasmuch as they use support paper or support film having a not negligible cost.

An object of the invention is to improve apparatuses and methods for decorating elongated elements, in particular section bar and metal sheets.

A further object is to provide apparatuses and methods that enable the time required for decorating a section bar to be reduced.

A still further object is to realize apparatuses that reduce the risk of accidentally damaging the section bar.

A still further object is to provide apparatuses and methods that enable production costs to be reduced.

Another object is to provide apparatuses and methods that enable the adhesion between the inks and the section bar to be improved in particularly hard situations of use.

Still another object is to provide a sublimation decorating method that is simple and cheap.

In a first aspect of the invention, an apparatus is provided comprising an advancing arrangement for advancing an elongated element in an advancing direction and a first decorating device for decorating a first surface of said elongated element, wherein it further comprises a second decorating device for decorating a second surface of said elongated element, said second surface being distinct from said first surface.

In a second aspect of the invention, a method is provided comprising moving an elongated element in an advancing direction, decorating a first surface of said elongated element, wherein downstream of said decorating there is provided further decorating a second surface of said elongated element, said second surface being distinct from said first surface.

Owing to these aspects of the invention it is possible to obtain an apparatus and a method in which the time that is necessary for decorating an elongated element and therefore production costs are significantly reduced.

In fact, the apparatus and the method according to the first two aspects of the invention enable decorating several surfaces of an elongated element in a single step, eliminating the demanding operations of rotation of the elongated element and repositioning the latter of known apparatuses.

This furthermore enables the risk of accidental knocking of the elongated element into objects arranged along the movement part to be eliminated.

In a third aspect of the invention, an apparatus is provided comprising a transferring device for transferring a flowable material on a surface of an object, wherein it further comprises a preheating device intended for acting before transferring said flowable material on said object, so as to enable said flowable material to better adhere to said object.

In a fourth aspect of the invention, a method is provided comprising transferring a flowable material on a surface of an object, wherein before said transferring a preheating step is provided for enabling said flowable material to better adhere to said object.

Owing to the third and to the fourth aspect of the invention it is possible to increase the adhesion between a flowable material, for example a UV ink, and an object, for example a section bar, also in particularly hard situations that occur, for example, when the section bar is installed in an external environment and remains exposed to atmospheric agents for a prolonged period of time.

In a fifth aspect of the invention, a method is provided comprising forming a sublimable pattern on an object and heating said object so that said sublimable pattern penetrates a surface layer of said object, wherein said forming comprises applying to said object a sublimable ink in a flowable state.

Owing to this aspect of the invention, it is possible to apply to a surface of an object a pattern formed of at least a sublimable ink, that penetrates the surface layer of the object, ensuring good adhesion of the sublimable pattern. Nevertheless, the sublimable ink is applied directly to the object in a flowable state, for example a liquid or powder state, without using transferring supports in paper or plastic film.

In this way it is possible to simplify the sublimation process and reduce production costs.

The invention can be better understood and implemented with reference to the enclosed drawings, that show an exemplifying and non limitative embodiment thereof, in which.

Figure 1:
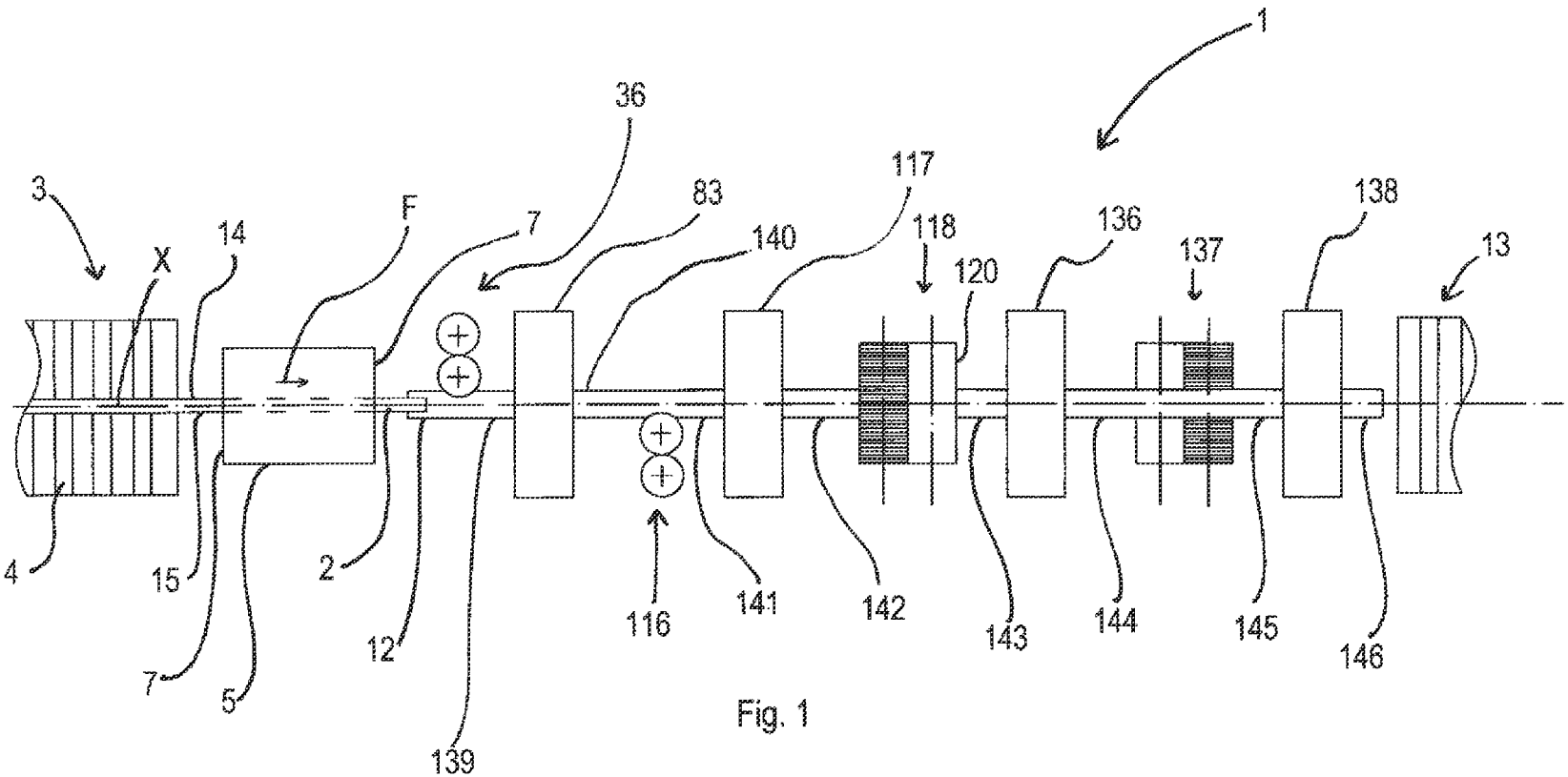
FIG. 1 is an interrupted and schematic plan view of an apparatus for decorating a section bar.

With reference to FIG. 1, an apparatus 1 for decorating an elongated element is shown, for example a section bar 2 or a metal sheet (not shown) that are usable in the building industry. The section bar 2 can be made of a metal material, for example aluminium, or plastics, for example polyvinyl chloride (PVC) and, after being decorated, can be used, for example, as a component of door or window frames.

Figure 2:
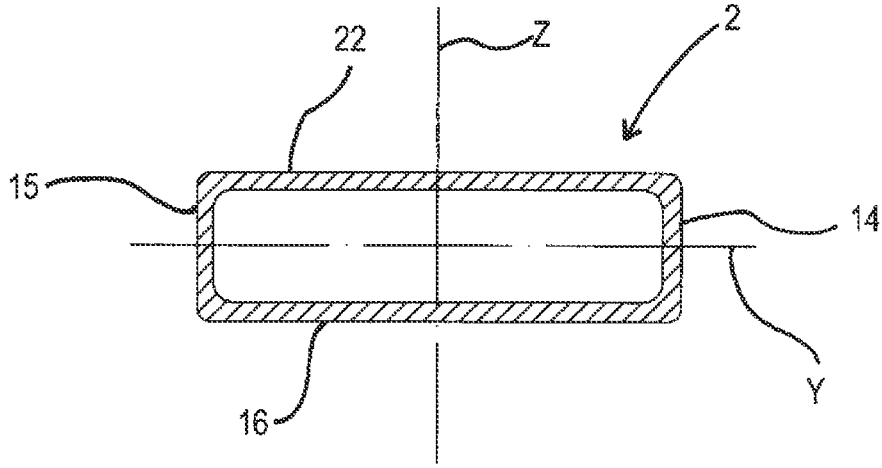
FIG. 2 is a cross section of a section bar.

The section bar 2, shown in detail in FIG. 2, may substantially have the shape of a bar with a rectangular section that is internally hollow and substantially extends along a longitudinal axis X.

In the specific case of FIG. 2, the section bar 2 is delimited by a first side surface 14, by a second side surface 15 opposite the first surface 14, by a third upper surface 22 and by a fourth lower surface 16 opposite the third surface 22. Nevertheless, the section bar 2 may have a cross section of a different shape from the one shown in FIG. 2, and may, for example, be provided with recesses and/or protrusions.

The section bar 2, before being introduced into the apparatus 1, may be previously coated with a bottom layer that defines the base colour of a desired decoration and which acts as a support for a subsequent decorative layer.

The bottom layer can be applied to the section bar 2 in the form of powder, or liquid or spray paint by means of known methods, for example of the electrostatic or spray type.

The bottom layer may not be necessary if the section bar 2 is already of the desired colour.

Once it has been prepared, the section bar 2 is ready to be positioned in the apparatus 1, which will apply to one or more of the surfaces of the section bar 2 a decorative layer made with a flowable material, for example an ink that is hardenable through exposure to ultraviolet rays (UV ink), according to a desired decorative pattern.

In particular, the decorative layer may reproduce the appearance of a surface of a natural material, such as wood or marble.

Initially, as shown in FIG. 1, the section bar 2 is placed on a first conveying device 3, for example a roller conveyor 4, or a belt conveyor that is not shown, that convey the section bar 2 in an advancing direction F that is substantially parallel to the longitudinal axis X.

Figure 3:
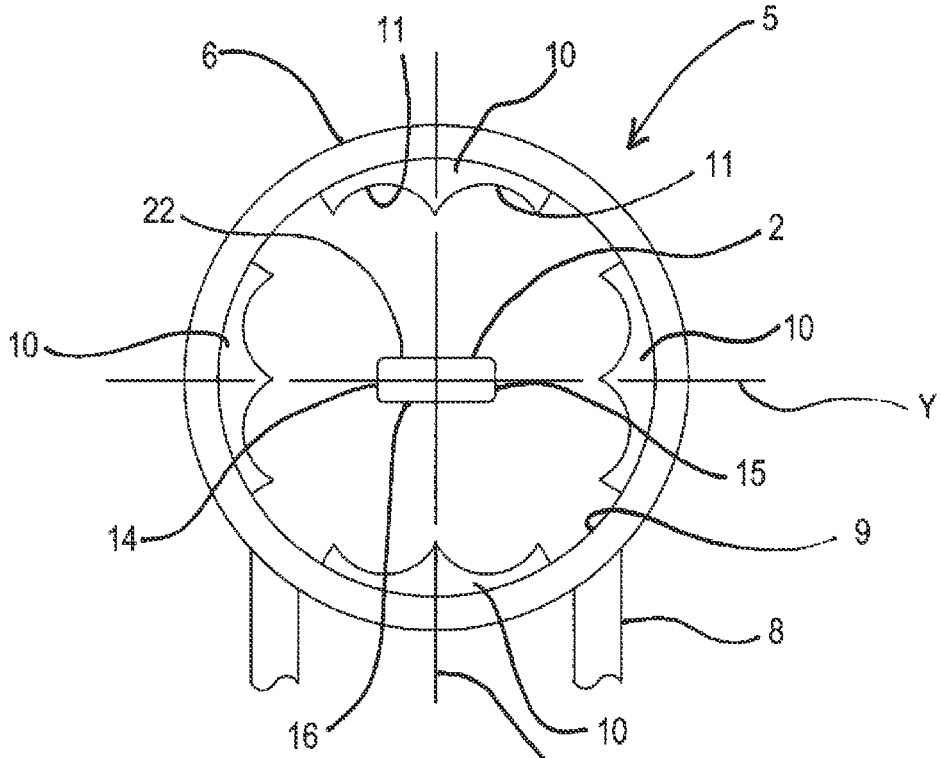
FIG. 3 is an interrupted and schematic frontal view of an infrared kiln with which the apparatus in FIG. 1 is provided.

The section bar 2, whilst it is advanced in the advancing direction F, is first introduced into an infrared ray kiln 5, shown in detail in FIG. 3.

The infrared ray kiln 5 is supported by a frame 8 and is provided with a hollow cylindrical shell 6, open at both ends 7 (FIG. 1) so as to be able to be traversed by the section bar 2 whilst the latter is advancing in the advancing direction F.

The cylindrical shell 6 comprises an internal surface 9 on which there is mounted a plurality of lampholders 10, for example four lampholders distanced from one another by about 90 °.

Each lampholder 10 supports a plurality of lamps 11 that emit infrared rays that interact with the section bar 2.

In particular, the lamps 11 enable the section bar 2 to be heated so as to bring it to a temperature comprised between approximately 30° C. and 70° C.

In an embodiment that is not shown, it is also possible to provide another type of kiln as an alternative to the infrared ray kiln 5.

After traversing the infrared ray kiln 5, the partially heated section bar 2 is received by a first advancing arrangement 12, positioned downstream of the infrared ray kiln 5 and arranged for conveying the section bar 2 in the advancing direction F.

Figure 4:
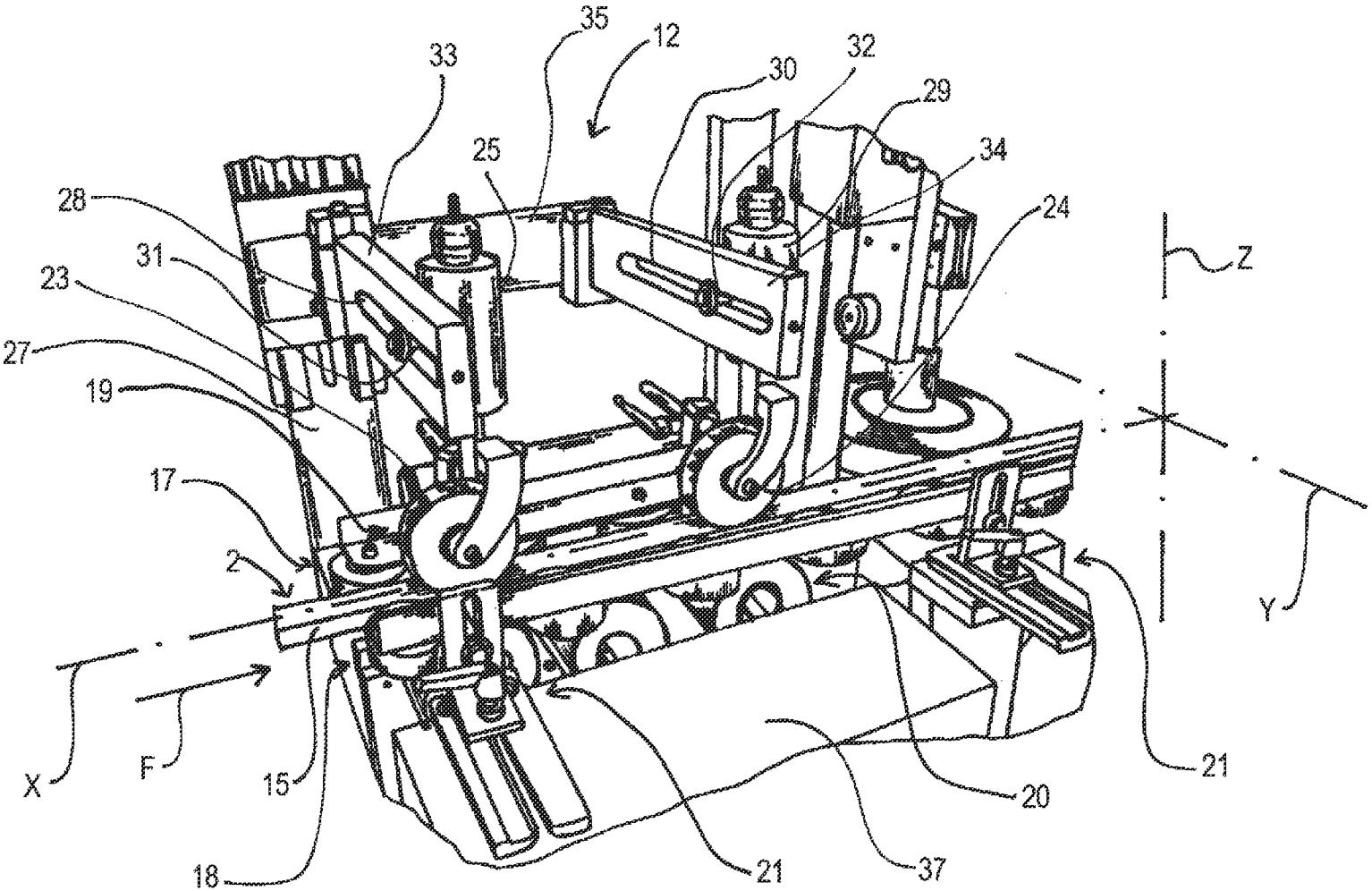
FIG. 4 is a perspective view of an advancing device of the apparatus in FIG. 1.

The first advancing arrangement 12, shown in detail in FIG. 4, comprises a first row of wheels 17, a second row of wheels 18 opposite the first row of wheels 17, a third row of wheels 19 and a fourth row of wheels 20 opposite the third row of wheels 19. The wheels of the first row of wheels 17 and of the second row of wheels 18 are rotatable around respective vertical axes, whereas the wheels of the third row of wheels 19 and of the fourth row of wheels 20 are rotatable around respective horizontal axes.

In particular, the first row of wheels 17 is arranged so as to define a first side rest plane for the first surface 14, the second row of wheels 18 is arranged so as to define a second side rest plane for the second surface 15, the third row of wheels 19 rests on the third surface 22 and the fourth row of wheels 20 is arranged so as to define a third rest plane for the fourth surface 16.

In this way, the first row of wheels 17, the second row of wheels 18, the third row of wheels 19 and the fourth row of wheels 20 cooperate together so as to prevent undesired movements of the section bar 2 along a transverse axis Y, arranged transversely to the advancing direction F, or along a vertical axis Z during the decorating steps, which movements would compromise the aesthetic quality of the decoration.

Furthermore, the second row of wheels 18 can be moved along the transverse axis Y by an adjusting device 21, so as to modify the distance between the first row of wheels 17 and the second row of wheels 18 so that section bars with different transverse dimensions can be introduced between these rows.

The third row of wheels 19 comprises a first wheel 23 and a second wheel 24 arranged along the advancing direction F, the second wheel 24 being positioned downstream of the first wheel 23.

The first wheel 23 and the second wheel 24 are supported by respective first a supporting device 25 and by a second supporting device 29, extending in a direction substantially parallel to the vertical axis Z.

The first supporting device 25 is mounted on a first cross member 33, extending in a direction substantially parallel to the transverse axis Y, through a first pivot 31 passing through a first slot 28 with which the first cross member 33 is provided.

Similarly, the second supporting device 29 is mounted on a second cross member 34, extending in a direction substantially parallel to the transverse axis Y, through a second pivot 32 passing through a second slot 30 with which the second cross member 34 is provided.

In particular, owing to the first slot 28 and to the second slot 30 it is possible to arrange respectively the first wheel 23 and the second wheel 24 in several positions in a direction substantially parallel to the transverse axis Y, so that the first wheel 23 and the second wheel 24 can be positioned approximately along the longitudinal axis X of section bars having different transverse dimensions.

Furthermore, the first cross member 33 and the second cross member 34 are fixable in an adjustable manner along a third cross member 35 that is vertically movable along an upright 27, so as to raise or lower the first wheel 23 and the second wheel 24 to receive section bars of different vertical dimensions.

If the section bar 2 has a significant dimension along the transverse axis Y, it is possible to mount a third wheel, that is not shown, and that is substantially similar to the first wheel 23 and to the second wheel 24. The third wheel may be positioned alongside the second wheel 24 in order to more effectively prevent the section bar 2 moving in a direction substantially parallel to the vertical axis Z.

In particular, the second wheel 24 and the third wheel, in use, will be arranged alongside one another substantially symmetrically with respect to the longitudinal axis X.

Lastly, the first advancing arrangement 12 is provided with a driving arrangement 37 arranged for moving the fourth row of wheels 20, whereas the first row of wheels 17, the second row of wheels 18 and the third row of wheels 19 are idle.

As shown in FIG. 1, the section bar 2 is moved by the first advancing arrangement 12 to a first decorating module 36.

Figure 5:
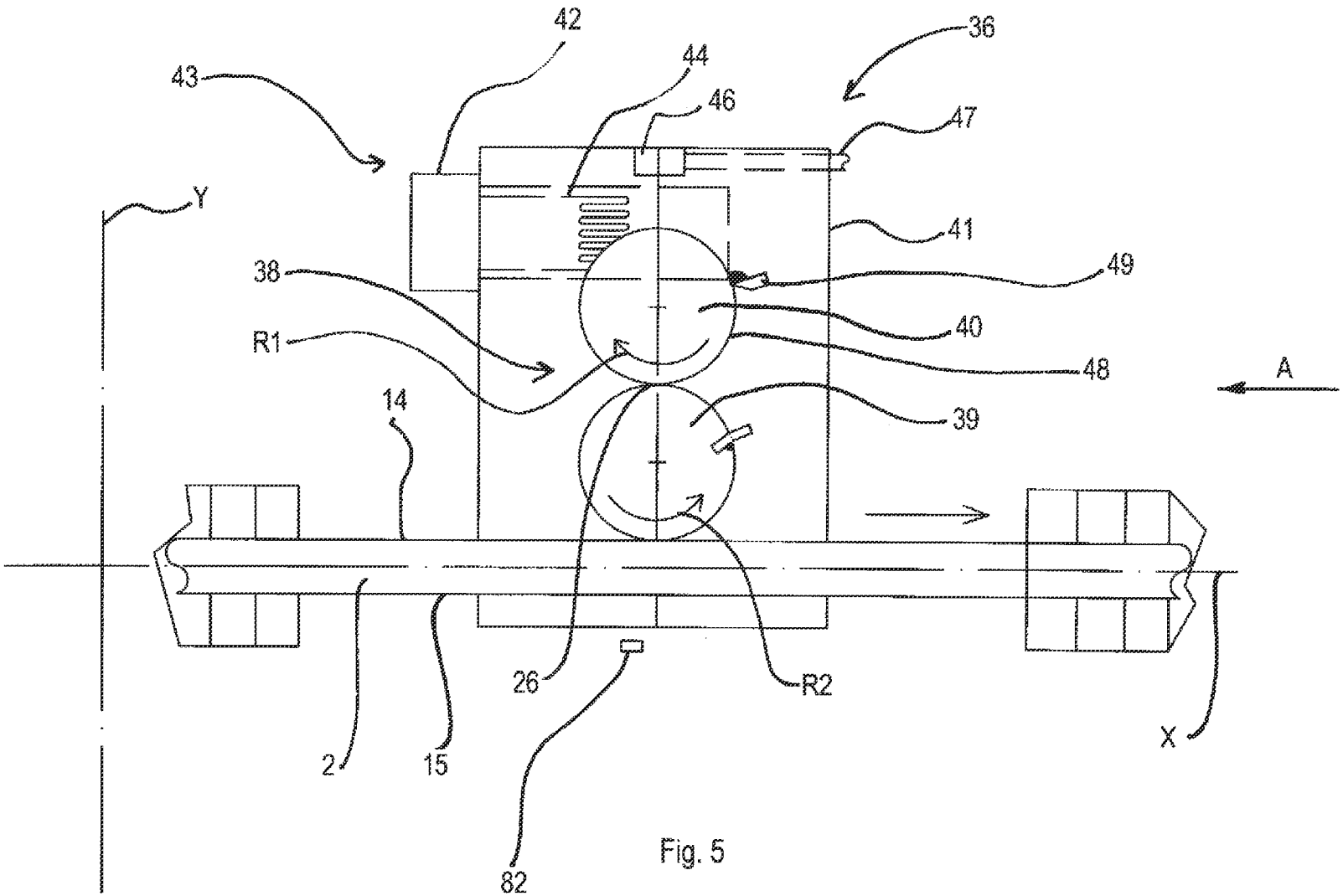
FIG. 5 is a schematic plan view of a decorating module of the apparatus in FIG. 1.
Figure 6:
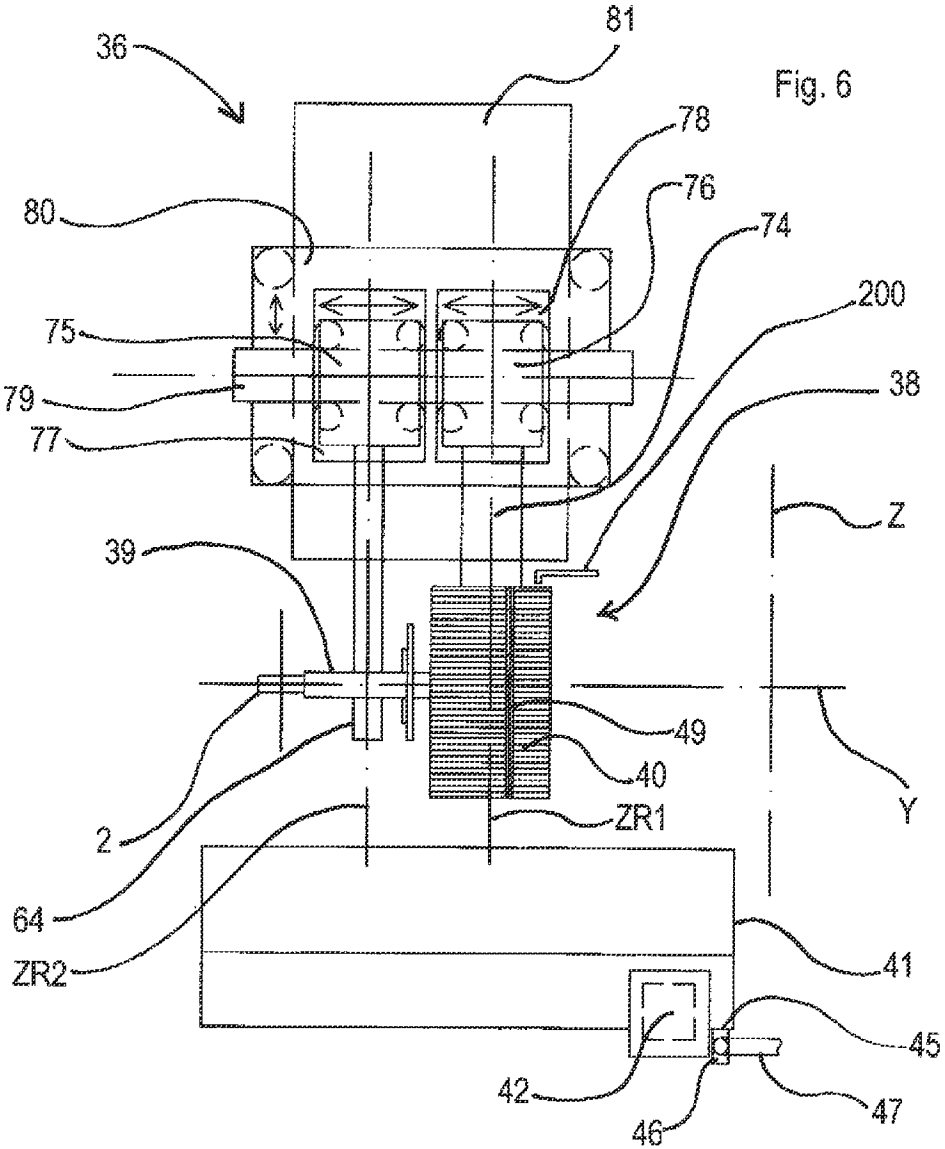
FIG. 6 is a schematic side view, taken along direction A, of the decorating module of FIG. 5.
Figure 7:
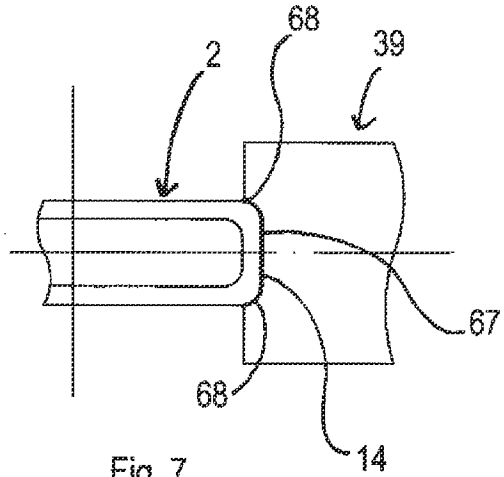
FIG. 7 is an enlarged detail of the decorating module in FIG. 6.

The first decorating module 36, shown in detail in FIGS. 5, 6 and 7, is arranged for decorating the first surface 14 of the section bar 2 through a decorating device 38.

The first decorating module 36 comprises a tank 41, positioned, in use, below the decorating device 38, that is sufficiently big to contain "new" UV ink intended for being applied to the section bar 2 and UV ink originating from the decorating device 38, as will be explained better below.

The tank 41 in a plan view (FIG. 5) has a substantially rectangular shape and is provided in an end zone 43 thereof with a preheating device 42 arranged for heating the UV ink at a temperature comprised between approximately 30° C. and 40° C.

The preheating device 42 comprises one or more electrical resistances 44 immersed in an oil bath.

In an embodiment that is not shown, it is also possible to provide a preheating device that is not provided with electrical resistances.

The tank 41 is further provided, in a region thereof below the end zone 43, with an opening 45 with which a connector 46 is associated into which a conduit 47 is fitted.

The conduit 47 is connected to a pump that is not shown that is connected by a further conduit that is not shown to a nozzle 200 that is arranged for pouring the UV ink taken from the tank 41 into the decorating device 38.

The decorating device 38 comprises a transferring roller 39 and a supplying roller 40 that are rotatable by a first rotating shaft 64 and by a second rotating shaft 74 respectively.

The first rotating shaft 64 and the second rotating shaft 74 are provided, near the ends thereof, with a respective movement transmission element, that is not shown, enclosed respectively by a first boxed element 75 and by a second boxed element 76.

The first boxed element 75 and the second boxed element 76 are fixed respectively to a first slide 77 and to a second slide 78 mounted on a horizontal guide 79 that extends parallel to the longitudinal axis Y.

Owing to the horizontal guide 79, the first slide 77 and the second slide 78 are movable independently of one another in a direction parallel to the longitudinal axis Y towards or away from the section bar 2.

Furthermore, the horizontal guide 79 is mounted on a plate 80 that is movable vertically along a vertical guide 81.

Owing to the horizontal guide 79 and to the vertical guide 81, both the supplying roller 40 and the transferring roller 39 are movable in directions substantially parallel to the vertical axis Z and to the transverse axis Y.

The supplying roller 40, made for example of metal material, is arranged for receiving on an external surface 48 thereof, the UV ink originating from the nozzle 200 and for applying it to the transferring roller 39.

The external surface 48 is beforehand engraved with the decorative pattern that it is desired to transfer to the sectin bar 2. This decorative pattern has been exemplified in the Figures that show the supplying roller 40 with a plurality of lines.

The decorative pattern can be defined by a plurality of cavities obtained on the external surface 48, in which case the supplying roller 40 operates according to a principle of intaglio printing, or by a plurality of raised parts obtained on the external surface 48, in which case the supplying roller 40 operates according to a principle of relief printing.

In an alternative embodiment, the supplying roller 40 can transfer to the transferring roller 39 a uniform layer of UV ink, if it is desired to apply the UV ink in a uniform manner to the section bar 2 without reproducing particular decorative patterns.

The supplying roller 40 is provided with a first doctor blade 49 extending substantially parallel to the vertical axis Z.

The first doctor blade 49 operates in contact with the external surface 48 and ensures that the UV ink substantially fills all the cavities of the supplying roller 40, at the same time keeping clean the regions that separate adjacent cavities.

Figure 8:
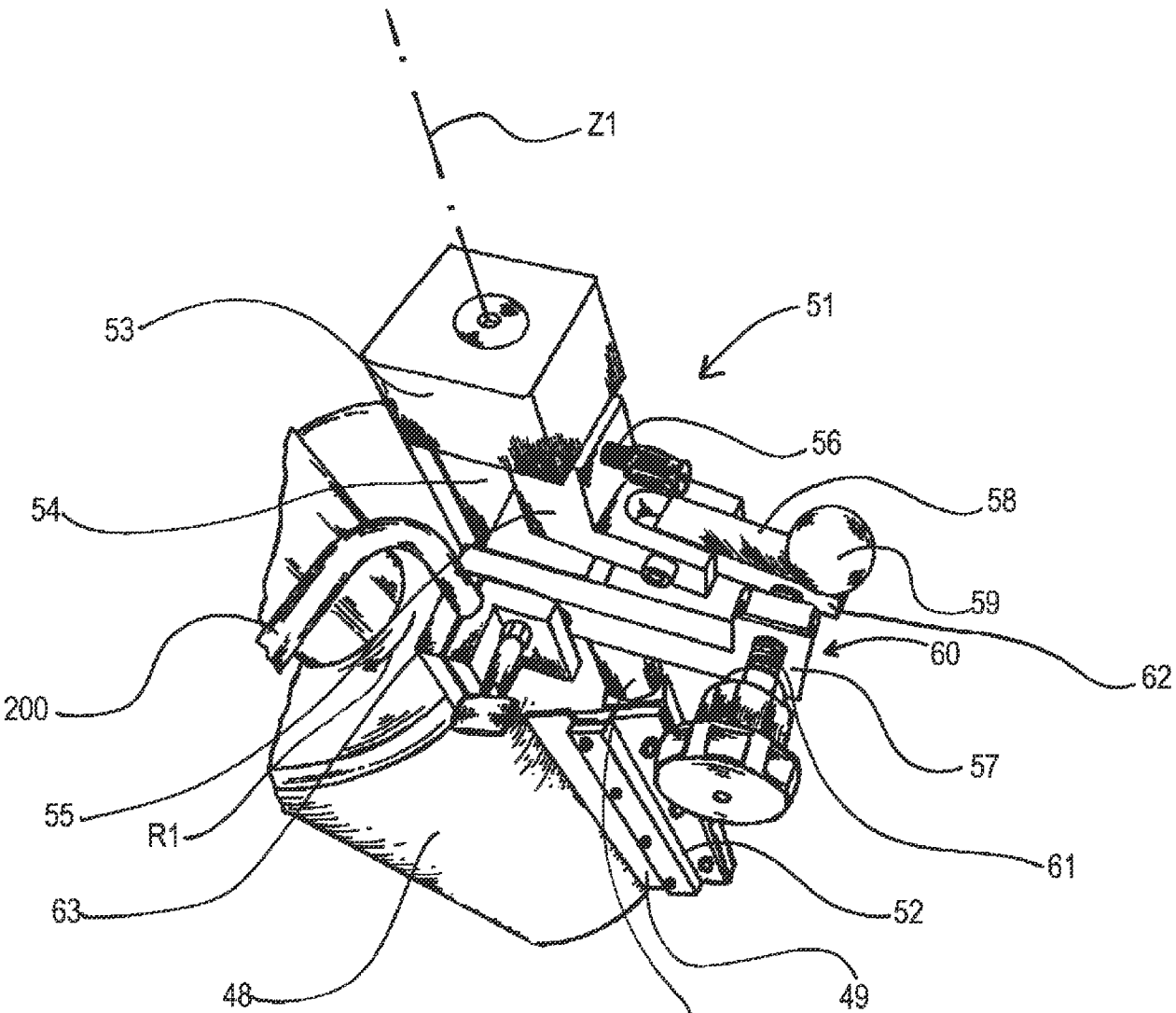
FIG. 8 is a schematic perspective view of a first doctor blade associated with the decorating module in FIG. 6.

The first doctor blade 49, shown in detail in FIG. 8, is supported by a supporting device 52 provided with a stem 50 connected to an adjusting device 51.

The adjusting device 51 enables the vertical position of the first doctor blade 49 to be adjusted and the tilt of the latter to be set with respect to the external surface 48, in function of the type or of the quantity of UV ink used.

In particular, the adjusting device 51 comprises a substantially "C"-shaped first element 53 provided with a niche 54 arranged for receiving a second essentially "L"-shaped element 55 that is movable with respect to the first element 53.

The first element 53 and the second element 55 are provided respectively with a first and a second through hole, which are not shown, arranged for being traversed by the stem 50. Furthermore, the second element 55 is provided with a third through hole, substantially perpendicular to the second through hole and communicating with the latter, arranged for being traversed by a threaded grubscrew 56 that, when it is tightened, prevents vertical movements of the stem 50.

If it is desired to remove the first doctor blade 49 of the adjusting device 51, for example to perform cleaning or maintenance tasks, it is sufficient to unscrew the threaded grubscrew 56 and remove the stem 50 downwards.

On the second element 55 a bar 58 is hinged that, projecting horizontally from the second element 55 and being provided with a knob 59, is graspable by an operator.

The adjusting device 51 is then provided with a third element 57 fixed to the first element 53.

The third element 57 comprises at a peripheral region thereof 60 a fourth through hole that can be traversed by a further threaded grubscrew 61 arranged for interacting with a face 62 of the bar 58.

By acting on the further threaded grubscrew 61 it is possible to make the latter interact with the bar 58, so as to rotate the bar 58 with respect to a vertical axis Z1 substantially coinciding with the axis of symmetry of the stem 50.

The stem 50, made integral with the second element 55 through the threaded grubscrew 56, is then forced to rotate together with the first doctor blade 49 associated therewith. In this way, the first doctor blade 49 can take on different tilts with respect to the first surface 48.

Lastly, on the third element 57 a clamp 63 is mounted that supports the nozzle 200.

As shown in FIG. 8, the nozzle 200 is positioned upstream of the first doctor blade 49 with respect to a rotation direction R1 of the supplying roller 40, so as to enable the first doctor blade 49 to perform the filling and cleaning functions thereof.

The supplying roller 40 rotates in the rotation direction R1 around a rotation axis ZR1, substantially parallel to a further rotation axis ZR2 of the transferring roller 39. The latter roller can rotate around the further rotation axis ZR2 in a further rotation direction R2.

The UV ink is transferred from the supplying roller 40 to the transferring roller 39 through contact between the two mutually rotating rollers.

The rotation directions of the rollers can be different from one another, as shown in FIG. 5, or the same as one another, depending on the quantity of UV ink that it is desired to apply to form the decorative layer.

In particular, to obtain a relatively great thickness of the decorative layer, the rollers rotate in a different direction from one another, whereas to obtain a lesser thickness the rollers rotate in the same direction as one another.

The further rotation direction R2 of the transferring roller 39 will anyway be the same as the advancing direction F of the section bar 2.

Figure 9:
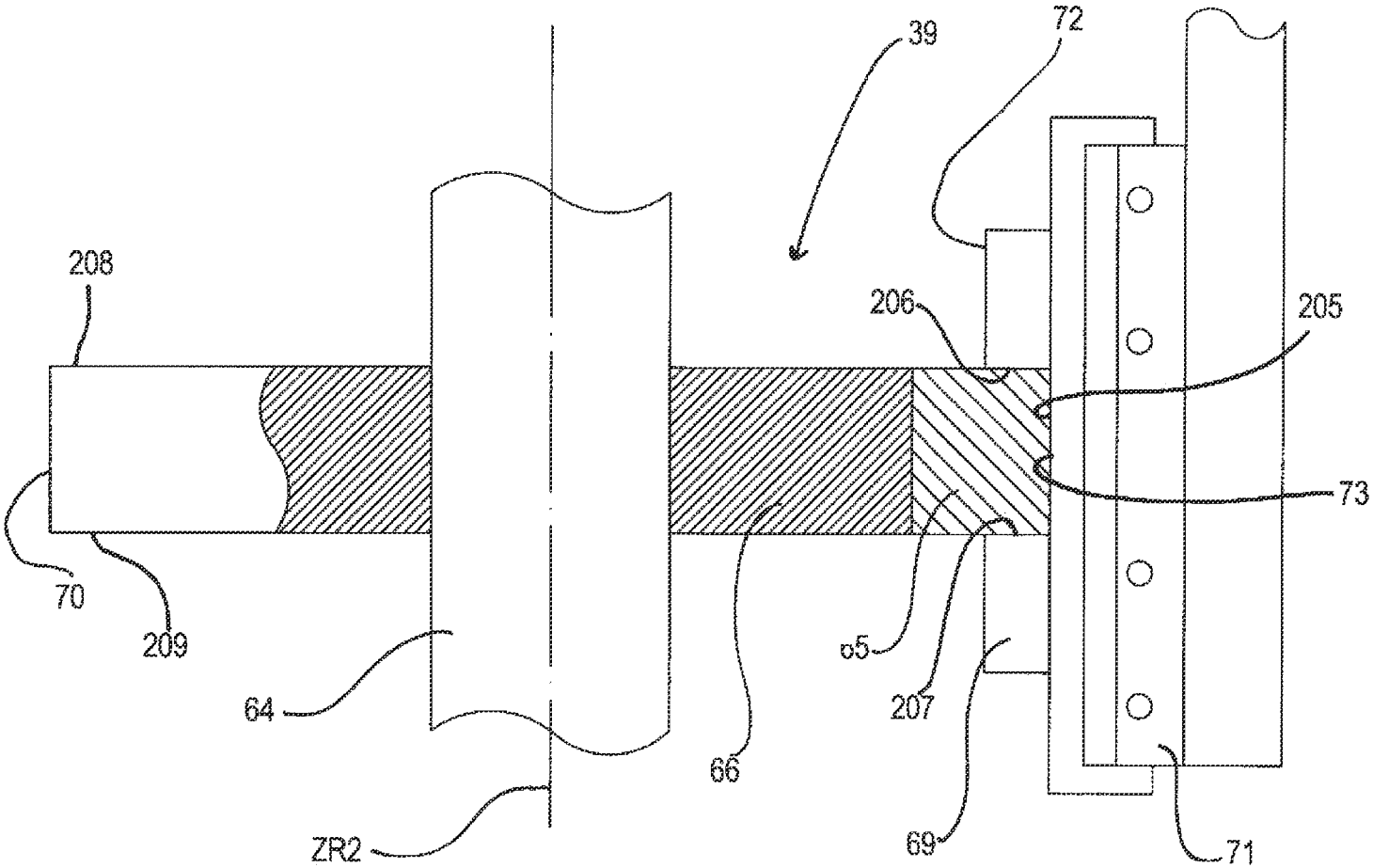
FIG. 9 is a schematic view of a second doctor blade associated with the decorating module in FIG. 6.

The transferring roller 39, shown in detail in FIG. 9, is mounted on the rotating shaft 64.

This transferring roller 39 is provided with an external layer 65 that is externally smooth and elastically deformable, made, for example, of rubber or silicone.

The external layer 65 is supported by an internal layer 66 made for example of metal.

Owing to the deformability of the external layer 65, the transferring roller 39 deforms, coming into contact with the section bar 2 and is then able to decorate the first surface 14 not only in a flat portion 67 thereof but also in two edge portions 68 thereof, having a rounded profile and adjacent to the flat portion 67 (FIG. 7).

Owing to the deformability of the transferring roller 39, decorating non-flat surfaces is also possible, for example that are provided with steps, recesses or raised zones.

As shown in detail in FIG. 9, the transferring roller 39 is provided with a shaped doctor blade 69 mounted on a support 71 and positioned upstream of a contact region 26 (FIG. 5) between the supplying roller 40 and the transferring roller 39 with respect to the further rotation direction R2.

In particular, the shaped doctor blade 69 is delimited, in the part intended for interacting with the transferring roller 39, by a straight edge 72 provided in a central region thereof with a recess 73 having a shape and dimensions such as to house a portion of the transferring roller 39.

For this purpose, the recess 73 is delimited by a vertical side 205, by a first horizontal side 206 and by a second horizontal side 207. The vertical side 205 is placed in contact with a side surface 70 of the transferring roller 39, so as to remove from this surface possible residues of UV ink that were not transferred to the section bar 2. The first horizontal side 206 and the second horizontal side 207 respectively interact with an upper surface 208 and with a lower surface 209 of the transferring roller 39, to prevent possible residues of UV ink deposited on the upper surface 208 or on the lower surface 209 from dirtying the side surface 70 of the transferring roller 39.

In an alternative embodiment that is not shown, the decorating device 38 can be provided only with a suitably engraved transferring roller onto which the UV ink is directly poured.

In a further alternative embodiment that is not shown the decorating device 38 can be provided with a smooth supplying roller and with an engraved transferring roller.

The first decorating module 36 is furthermore provided with a sensor device 82, for example a photocell-reflector pair, positioned upstream of the decorating device 38 and arranged for detecting the passage of a front end of the section bar 2.

The sensor device 82, when it detects that the front end of the section bar 2 has gone past, emits a signal that rotates the first rotating shaft 64 and the second rotating shaft 74 and moves the first slide 77 and the second slide 78 so that the transferring roller 39 comes into contact with the first surface 14.

Owing to the sensor device 82, the transferring roller 39 is brought into contact with the section bar 2 an instant after a front edge of the section bar 2 has gone past the transferring roller 39. In this way, it is avoided that the front edge of the section bar 2, which may have cutting burrs, comes into contact with the transferring roller 39 and damages the latter.

At this point, the section bar 2 with the first surface 14 that has just been decorated is introduced by a second advancing arrangement 139, substantially and functionally similar to the first advancing arrangement 12, into a first ultraviolet rays (UV) kiln 83 that hardens the UV ink through polymerisation.

Figure 10:
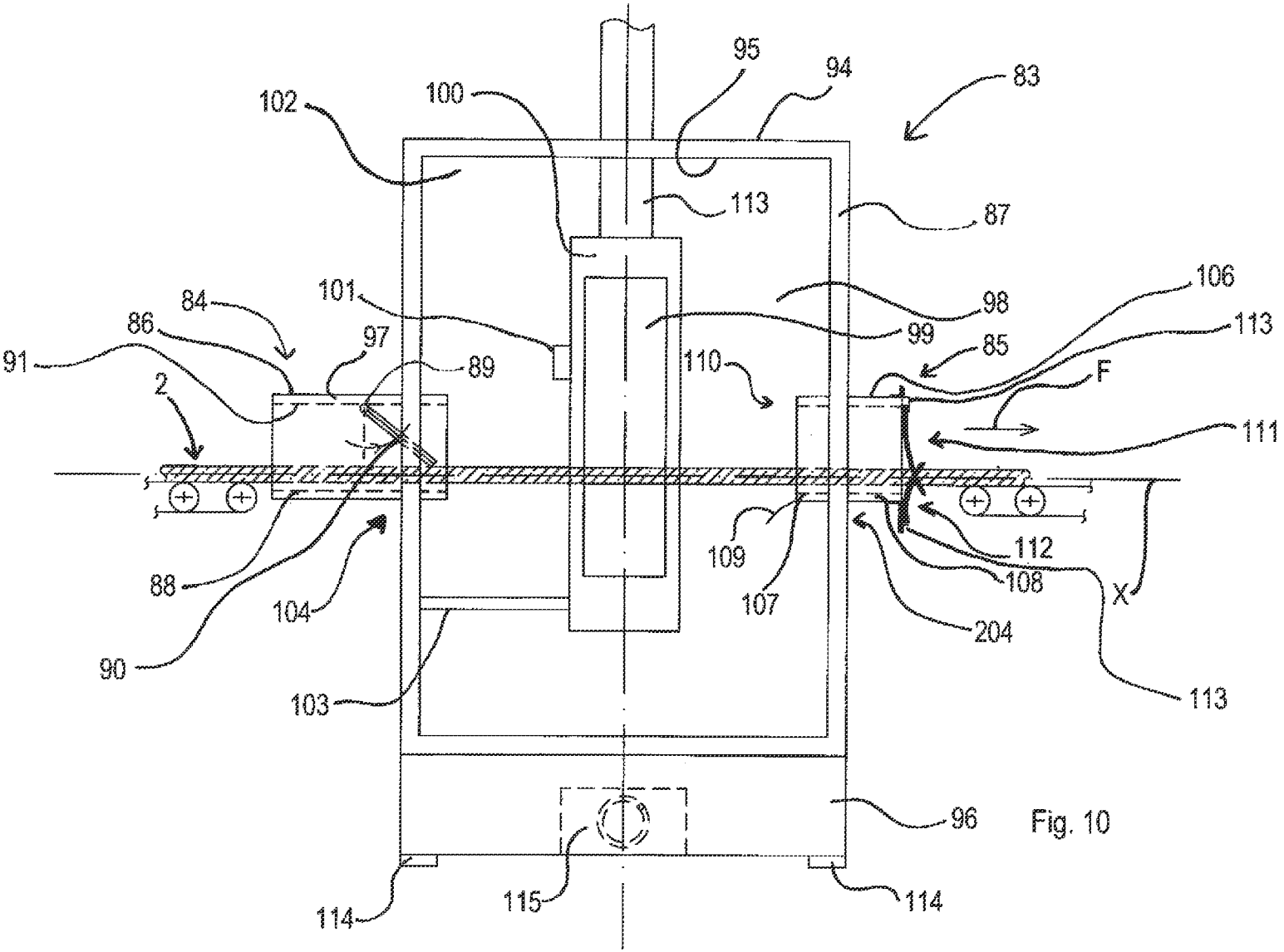
FIG. 10 is a schematic view of an ultraviolet kiln with which the apparatus in FIG. 1 is provided.

With reference to FIG. 10, there is shown the first UV ray kiln 83 without a closing panel.

The first UV ray kiln 83 is provided with an external frame 94 and with an internal frame 95, mounted on a base 96.

Between the external frame 94 and the internal frame 95 a first gap 87 is defined arranged for effectively isolating the first UV ray kiln 83 from the external environment, preventing the operator from getting burns due to accidental contact with the external frame 94.

Within the internal frame 95 a chamber 98 is defined in which a lamp 99 is housed that emits ultraviolet rays. The section bar 2 passes in front of the lamp 99 that is positioned in such a way as to emit the ultraviolet rays onto the first surface 14 of the section bar 2, previously decorated by the first decorating device 38.

The lamp 99 is mounted on a further lampholder 100 that extends substantially vertically and is fixed to a bottom wall 102 of the internal frame 95 through fixing elements 101.

The further lampholder 100 is connected at an end region thereof to an electric cable 103 that powers the lamp 99. Furthermore, with the further lampholder 100 there is associated a suction pipe 113 communicating with the external environment, arranged for keeping the temperature of the lamp 99 uniform and for conveying to the exterior the ozone produced by the ultraviolet rays.

The first UV ray kiln 83 is furthermore provided with an inlet element 84 and with an outlet element 85 that enable the entry and exit from the first UV rays kiln 83 of the section bar 2 and prevent the accidental escape of UV rays. The inlet element 84 is obtained in a first side region 104 of the first UV rays kiln 83 and comprises a first tubular element 86 and a second tubular element 88 that are substantially concentric so as to define a second gap 97.

Owing to the second gap 97, that acts as an insulator, it is possible for an operator to touch the first tubular element 86 without getting burnt.

On an upper portion 91 of the second tubular element 88 a door 90 is hinged through hinges 89, which door 90 oscillates around a transverse axis substantially parallel to the transverse axis Y.

Figure 11:
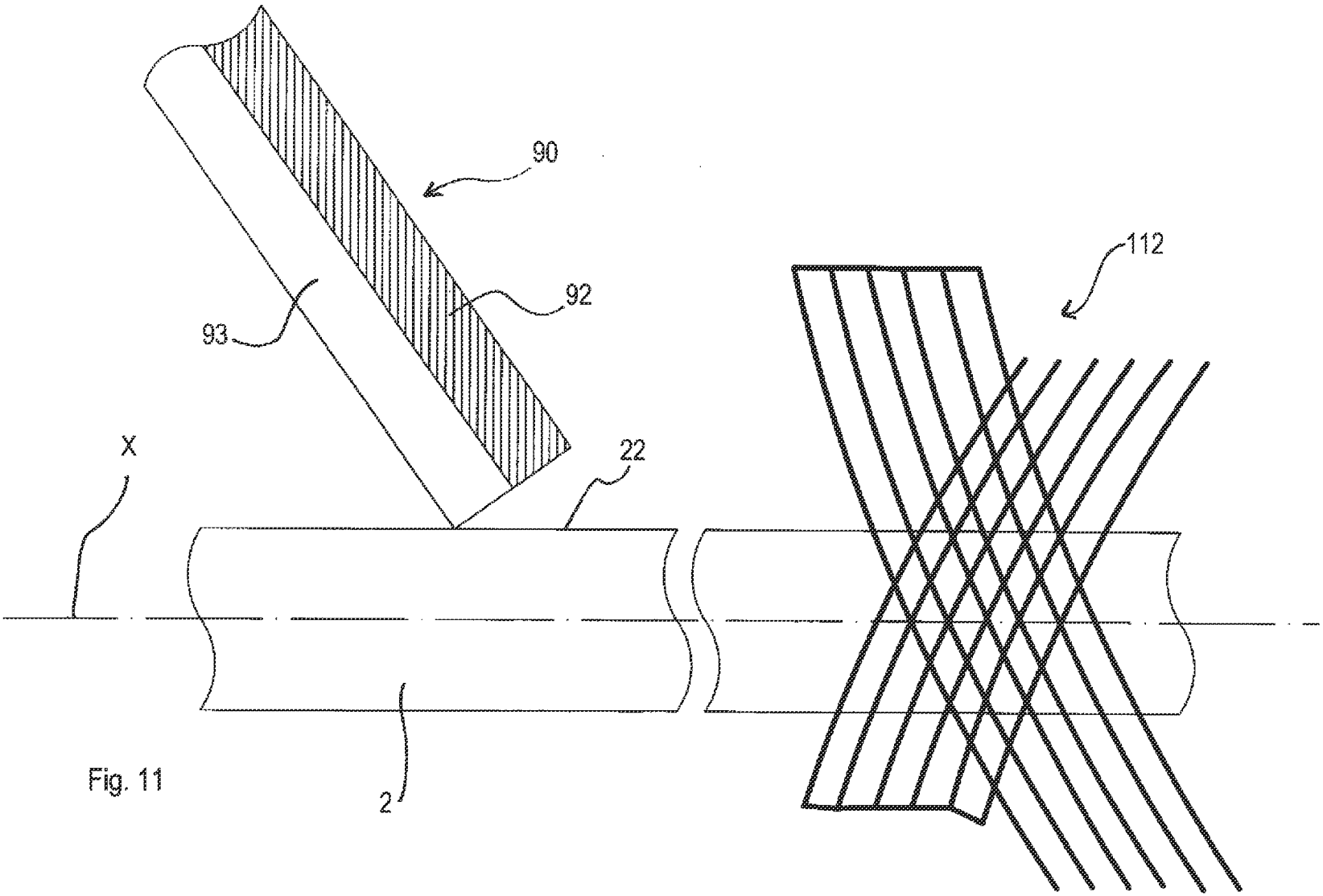
FIG. 11 is a fragmentary and enlarged schematic view showing two details of the kiln in FIG. 10.

The door 90, shown in detail in the left portion of FIG. 11, is made with two distinct layers, comprising a first layer 92 facing towards the inside of the first UV ray kiln 83 and a second layer 93 facing towards the outside of the first UV ray kiln 83 so as to come into contact with the third surface 22 of the section bar 2.

In particular, the first layer 92 can be made with a metal material so as to shield the operator in a more effective manner from the ultraviolet rays coming from the first ultraviolet rays (UV) kiln 83, whilst the second layer 93 can be made of plastic material with a low friction coefficient, for example polytetrafluorethylene. This both enables the third surface 22 not to be damaged that slides under the second layer 93 when the section bar 2 advances in the advancing direction F, and to improve sliding between the section bar 2 and the door 90.

It should be noted that the section bar 2 enters the first UV ray kiln 83 without the first surface 14, to which the UV ink that has not yet hardened is applied, touching the components of the aforementioned first kiln. In fact, only the third surface 22, to which the UV ink has not yet been applied, comes into contact with the door 90. This enables the layer of UV ink that has not yet hardened that has been deposited on the first surface 14 not to be damaged.

The outlet element 85 is obtained in a second side region 204 of the first UV rays kiln 83 and comprises a third tubular element 106 and a fourth tubular element 107 that are substantially concentric so as to define a third gap 108.

Owing to the third gap 108, that acts as an insulator, it is possible for an operator to touch the third tubular element 106 without getting burnt.

The outlet element 85 is furthermore provided, in a first zone 110 thereof, with a chute 109 that guides the front edge of the section bar 2 to a second zone 110 of the outlet element 85, in which a brush device 112 is provided, shown in the right portion of FIG. 11. The brush device 112 is supported by a holder 213 and is used to shield the operator from the ultraviolet rays coming from the first ultraviolet rays (UV) kiln 83.

When the section bar 2 leaves the first UV ray kiln 83, the decoration applied previously to the first surface 22 has already hardened and can interact with the brush device 112 without being damaged.

The first UV ray kiln 83 can be moved along a guide device 114 in a direction substantially parallel to the transverse axis Y owing to a further driving arrangement 115.

The further driving arrangement 115 enables the position of the first UV ray kiln 83 and in particular of the lamp 99 to be modified, transversely to the advancing direction F. This enables the lamp 99 to be moved with respect to the first surface 14 of the section bar 2, the position of which is kept fixed transversely to the advancing direction F.

In other words, by acting on the further driving arrangement 115 it is possible to suitably adjust the distance between the lamp 99 and the first surface 14 inside the chamber 98 so that this distance is near a value of about 3 cm, which enables a good decoration of the section bar 2.

In an embodiment that is not shown, within the chamber 98 a gallium lamp can be positioned upstream of the lamp 99 with respect to the advancing direction F. The gallium lamp enables the photoinitiators to be activated that are found in some types of ink and the deeper layers of ink applied by the transferring roller 39 to be hardened. This is useful when the ink used contains pigments that could block out the UV rays, preventing the latter from reaching the deeper layers of ink, which would thus not be polymerised. Subsequently, the lamp 99 emits UV rays that completely harden the ink that has already been partially hardened by the gallium lamp.

At the outlet from the first UV ray kiln 83 there is a third advancing arrangement 140, substantially and functionally similar to the first advancing arrangement 12. The third advancing arrangement 140 conveys the section bar 2 to a second decorating module 116, that is not shown in detail, arranged for decorating, if desired, the second surface 15 of the section bar 2.

The second decorating module 116 is substantially and functionally similar to the first decorating module 36 and is positioned along the advancing direction F so that the corresponding transferring roller faces the second surface 15, so as to decorate this surface. For this purpose as shown in FIG. 1, the second decorating module 116 comprises a second decorating device operationally arranged on a side of the longitudinal axis X opposite the first decorating device 38.

At the outlet of the second decorating module 116 the section bar 2 is conveyed by a fourth advancing arrangement 141, substantially and functionally similar to said first advancing arrangement 12, to a second UV ray kiln 117 arranged to harden through polymerisation the UV ink just applied to the second surface 15.

The second UV ray kiln 117 is substantially and functionally similar to the first UV ray kiln 83, from which it mainly differs because it comprises a respective UV lamp that during operation faces the second surface 15.

At the outlet from the second UV ray kiln 117 a fifth advancing arrangement 142 is present, substantially and functionally similar to said first advancing arrangement 12, that conveys the section bar 2 to a third decorating module 118 (FIG. 12) arranged for decorating, if desired, the third surface 22 of the section bar 2.

The third decorating module 118 comprises a further decorating device 119 that is vertically movable through a slide arrangement that is not shown, towards, or away from the third surface 22, as indicated by the arrow F1.

This enables the further decorating device 119 to be positioned in use in contact with the third surface 22 to decorate it and to be able to interact with section bars having vertical dimensions that are different from one another.

The further decorating device 119 comprises a further transferring roller 120 and a further supplying roller 121 functionally similar respectively to the transferring roller 39 and to the supplying roller 40.

The further supplying roller 121 differs from the supplying roller 40 inasmuch as the further supplying roller 121 is rotationally rotatable in a rotation direction R4 around a rotation axis ZR4 substantially parallel to the transverse axis Y.

In particular, the rotation axis ZR4 substantially coincides with the geometrical axis of the further supplying roller 121.

The further supplying roller 121 is furthermore provided with a further first doctor blade 122 that substantially extends parallel to the rotation axis ZR4 and is in contact with a further external surface 123 of the further supplying roller 121.

In particular, the further first doctor blade 122 is positioned downstream of the rotation direction R4, of a further nozzle that is not shown arranged for pouring the ink onto the further external surface 123, and has functions substantially similar to those of the first doctor blade 49. Furthermore, the further supplying roller 121 is movable in a direction FX that is substantially parallel to the advancing direction F, so as to engage, or disengage, as necessary, with the further transferring roller 120.

Like the transferring roller 39, also the further transferring roller 120 is provided with a smooth external layer made of elastically deformable material, for example rubber or silicone. The further transferring roller 120 is rotationally movable in a rotation direction R3 around a rotation axis ZR3 substantially parallel to the transverse axis Y.

In particular, the rotation axis ZR3 substantially coincides with the geometrical axis of the further transferring roller 120.

Figure 12:
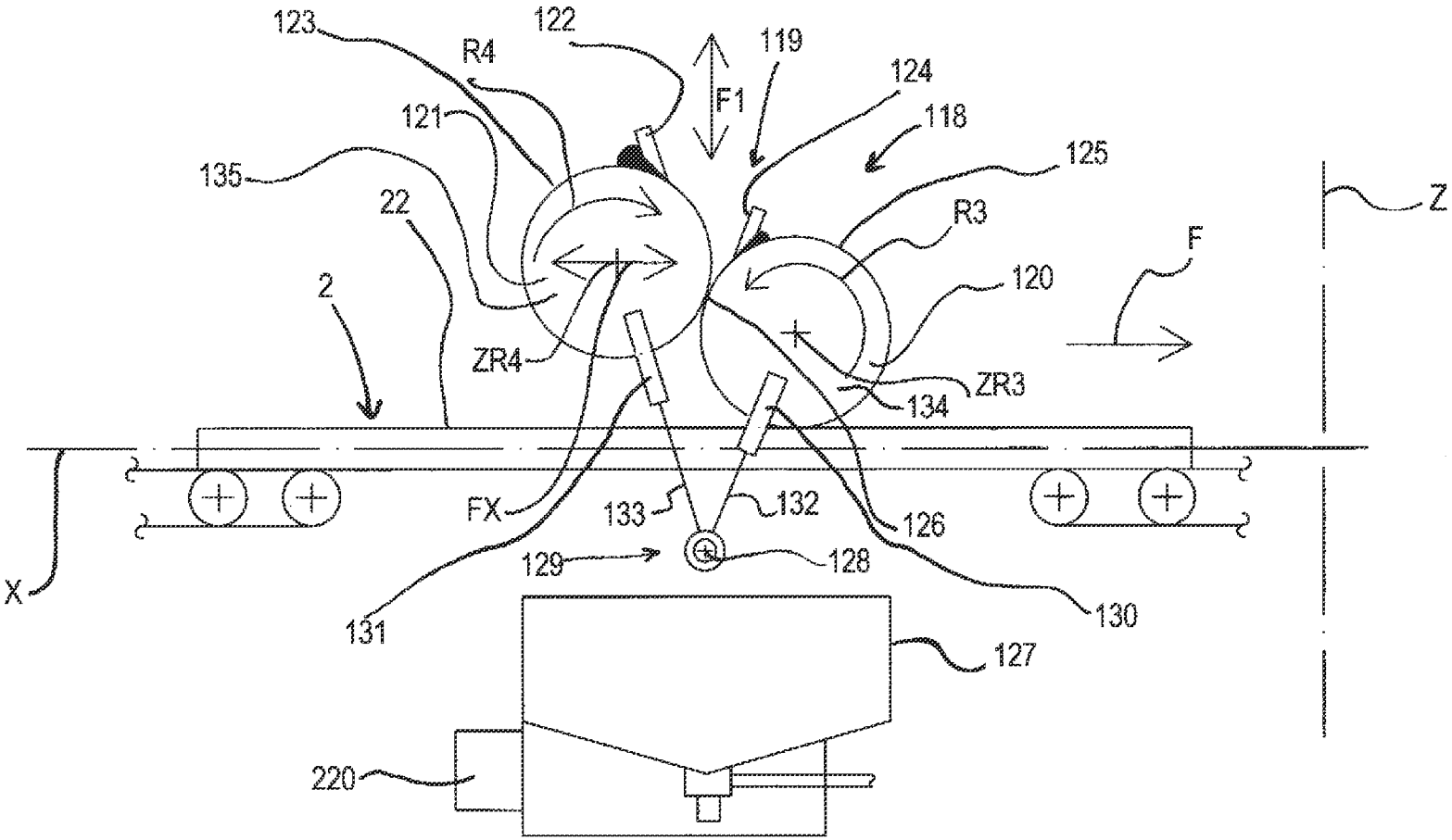
FIG. 12 is a schematic side view of a further decorating module of the apparatus in FIG. 1.

The rotation directions of the further rollers 120 and 121 may be different from one another, as shown in FIG. 12, or the same as one another, depending on the quantity of UV ink that it is desired to apply to form the decorative layer, as described previously.

The rotation direction R3 of the further transferring roller 120 will nevertheless be the same as the advancing direction F of the section bar 2.

Furthermore, as shown in FIG. 1, the further transferring roller 120 has a significant length transversely to the advancing direction F, so as to be able to decorate section bars having very extended upper surfaces and also metal sheets.

The further transferring roller 120 then interacts on a peripheral surface 125 thereof with a second doctor blade 124, extending substantially parallel to the rotation axis ZR3 and positioned upstream with respect to the rotation direction R3 of a further contact region 126 between the further supplying roller 121 and the further transferring roller 120.

In particular, the second doctor blade 124 has the function of cleaning the peripheral surface 125 of possible UV ink residues remaining thereupon after application of the UV ink to the third surface 22.

The third decorating module 118 is furthermore provided with a further tank 127 positioned below the further decorating device 119.

The further tank 127 is substantially and functionally similar to the tank 41 and in particular comprises a further preheating device 220 for heating the UV ink before applying it to the section bar 2.

Furthermore, the third decorating module 118 is provided with a shaft 128 extending above the further tank 127 in a direction substantially parallel to the transverse axis Y.

With a first end 129 of the shaft 128, a first doctor blade holding element 132 and a second doctor blade holding element 133 are associated.

The first doctor blade holding element 132 and the second doctor blade holding element 133 are arranged for respectively supporting a third doctor blade 130 and a fourth doctor blade 131.

In particular, the third doctor blade 130 cleans a first substantially flat base surface 134 of the further transferring roller 120, whereas the fourth doctor blade 131 cleans a second base surface 135, which is also substantially flat, of the further supplying roller 121. The first base surface 134 and the second base surface 135 are in fact contaminated by the UV ink that the second doctor blade 124 and the further first doctor blade 122 remove respectively from the peripheral surface 125 and from the external surface 123 and which tends to flow to the further tank 127.

Similarly, at a second end that is not shown of the shaft 128, opposite the first end 129, a third doctor blade holding element and a fourth doctor blade holding element are associated arranged for respectively supporting a fifth doctor blade and a sixth doctor blade that are not shown.

In particular, the fifth doctor blade cleans a further first base surface of the further transferring roller 120, whereas the sixth doctor blade cleans a further second base surface of the further supplying roller 121.

Furthermore, the third doctor blade 130, the fourth doctor blade 131, the fifth doctor blade and the sixth doctor blade enable the UV ink removed from the further transferring roller 120 and from the further supplying roller 121 to be conveyed to the further tank 127.

Once the third surface 22 has been decorated, the section bar 2 is conveyed by a sixth advancing arrangement 143, substantially and functionally similar to said first advancing arrangement 12, to a third UV ray kiln 136, that is not shown in detail.

The third UV ray kiln 136 differs from the first UV ray kiln 83 in the disposition of the respective door through which the section bar 2 enters the third UV ray kiln 136 and in the positioning of the respective UV lamp.

In particular, the door of the third UV ray kiln 136 is hinged, at a lower portion thereof, to a frame of the third UV ray kiln 136 and may oscillate around a transverse axis substantially parallel to the transverse axis Y.

This enables the door to interact with the fourth surface 16, that is not yet decorated, so as not to damage the third surface 22 that is still coated by UV ink that has not hardened.

On the other hand, the UV lamp of the third UV ray kiln 136 is arranged in a position facing the third surface 22 and is provided with a moving system that enables it to move towards or away from, the third surface 22 so as to be able to be positioned at an optimal distance from the third surface 22, for example 3 cm.

At the outlet from the third UV ray kiln 136 there is a seventh advancing arrangement 144, substantially and functionally similar to said first advancing arrangement 12, that conveys the section bar 2 to a fourth decorating module 137, that is not shown in detail, arranged for decorating, if desired, the fourth surface 16 of the section bar 2.

The fourth decorating module 137 is substantially and functionally similar to the third decorating module 118. Nevertheless, the fourth decorating module 137 is positioned in the advancing direction F below the section bar 2, so that the corresponding further transferring roller faces the fourth surface 16.

Furthermore, with respect to the third decorating module 118, the further transferring roller of the fourth decorating module 137 precedes in the advancing direction F of the corresponding further supplying roller.

At the outlet from the fourth decorating module 137 the section bar 2 is conveyed by an eighth advancing arrangement 145, substantially and functionally similar to said first advancing arrangement 12, to a fourth UV ray kiln 138 arranged for hardening through polymerisation the UV ink just applied to the fourth surface 16.

The fourth UV ray kiln 138 differs from the third UV ray kiln 136 through the arrangement of the respective door through which the section bar 2 can enter the fourth UV ray kiln 138 and through the positioning of the respective UV lamp.

In particular, the door of the fourth UV ray kiln 138 is hinged in a similar manner to the door 90 of the first UV ray kiln 83.

This enables the door of the fourth UV ray kiln 138 to interact with the third surface 22, the ink of which has already been polymerised, so as not to damage the fourth surface 16 still covered coated by UV ink that has not hardened.

Furthermore, the UV lamp of the fourth UV ray kiln 138 is positioned in such a way as to be, during operation, below the section bar 2 so as to face the fourth surface 16. Also the fourth UV ray kiln 138 is provided with a movement system that enables the respective UV lamp to be taken to approach the fourth surface 16 and the lamp to be moved away from the fourth surface 16, to position the lamp UV at an optimal distance from the section bar 2.

At the outlet from the fourth UV ray kiln 138 there is a ninth advancing arrangement 146, substantially and functionally similar to said first advancing arrangement 12, that conveys the section bar 2 to second conveying device 13 substantially similar to the first conveying device 3.

It should be noted that with the apparatus 1 it is possible to drastically reduce the process time required for decorating an elongated element and consequently production costs, enabling several surfaces of the elongated element to be decorated with a single step through the apparatus 1 and eliminating demanding moving operations of the elongated element that are necessary using known machines.

This furthermore enables the risk of accidental collisions of the elongated element with objects arranged along the movement path to be avoided.

It should furthermore be known that owing to the preheating of the elongated element and to the preheating of the UV inks it is possible to increase adhesion between the UV inks and the elongated element in particularly hard situations, thus improving the aesthetic effect of the decoration.

In an embodiment that is not shown, the decorating modules with the respective UV ray kilns can be positioned in the advancing direction F in any order.

In a further embodiment that is not shown, only two or three decorating modules may be present if it is desired to decorate only two or three surfaces of the object.

It is also possible to use more than four decorating modules if the section bar to be decorated has more than four surfaces, it being for example provided with a pentagonal section and if it is desired to apply to the same surface two or more inks of colours that differ from one another.

Each decorating module can be provided with an adjusting device for tilting the axis of the respective transferring roller and of the respective supplying roller. This enables also section bars to be detected that are delimited by tilted surfaces, i.e. that lie neither on a horizontal plane or on a vertical plane, for example section bars with a triangular cross section.

If inks are not used that harden exclusively after exposure to UV rays, each decorating module can be provided, instead of with a respective ultraviolet rays kiln, with a kiln of different type, for example an infrared-ray or hot-air kiln. It is also possible to use the apparatus 1 for applying to an object, for example a metal sheet or a section bar, a sublimable ink instead of the UV ink to which reference has been made so far. The sublimable ink can be applied to the object in liquid state, so as to form a uniform space that coats the entire object or a decoration that coats only some preset zones. The sublimable ink can be applied by using decorating modules that are similar to those disclosed with reference to FIGS. 1, 5, 6 and 12.

The object to which the sublimable ink has been applied is introduced into a kiln and heated to a temperature that is sufficient for sublimate the sublimable ink, enabling the ink to penetrate a few micrometers inside the surface of the object. This temperature can be comprised between 170° C. and 240° C. In this way, the sublimable ink is firmly attached to the surface of the object.

The kiln may be of the UV-ray type or of another type, for example IR-ray or hot-air kilns.

Furthermore, in order to improve the adhesion of the subliminable ink to the object, it is possible to preheat the object and/or the sublimable ink for example by means of preheating devices of the type disclosed previously.

By applying the sublimable ink in liquid state to the object to be decorated and by subsequently heating the object to make sublimation to occur, the use of paper or plastic film transferring supports previously printed with the sublimable decoration, until now used in a known decorating arrangement based on sublimation, is avoided.

The invention claimed is:

1. Decorating apparatus comprising an advancing arrangement for advancing an elongated element in an advancing direction substantially parallel to the longitudinal axis of said elongated element and a plurality of decorating devices positioned downstream one another along said advancing arrangement for decorating distinct surfaces of said elongated element, each decorating device comprising a decorating unit for decorating a respective surface of said elongated element, said decorating unit comprising:

a transferring device for transferring a flowable material on said elongated element, wherein said transferring device comprises a transferring roller rotatable around a rotation axis and arranged for interacting with said elongated element, said transferring roller being made of deformable material so that non-flat surfaces can be decorated;

a kiln arrangement arranged downstream of said transferring device for heating said flowable material applied to said elongated element;

wherein said decorating unit comprises a moving system associated with said transferring device for moving said transferring device towards or moving said transferring device away from said elongated element; and wherein said moving system is actuatable by a detecting member so as to move said transferring device towards said elongated element after detecting that a front edge of said elongated element has moved near said transferring device.

2. Apparatus according to claim 1, wherein said moving system is configured in such a manner as also to move a supplying roller towards and away from said elongated element, said supplying roller being rotatable around a further rotation axis for applying said flowable material to said transferring roller.

3. Apparatus according to claim 1, wherein said decorating unit comprises a preheating device for heating said flowable material before transferring said flowable material to said elongated element.

4. Apparatus according to claim 3, wherein said preheating device is associated with a tank element, so as to heat said flowable material contained in said tank element.

5. Apparatus according to claim 1, wherein said kiln arrangement comprises door elements that are openable from a further surface of said elongated element different from said respective surface for making said elongated element enter inside said kiln arrangement.

6. Apparatus according to claim 5, wherein said door elements comprise a first layer that supports a second layer in plastics, said second layer being arranged for interacting with said further surface.

7. Apparatus according to claim 1, wherein said kiln arrangement comprises an emitting device for emitting ultraviolet rays for hardening said flowable material applied to said elongated element and a gallium lamp arranged upstream of said emitting device.

8. Apparatus according to claim 1, wherein said kiln arrangement is provided with a driving arrangement for moving said kiln arrangement towards, or away from said elongated element.

9. Apparatus according to claim 1, and further comprising a further preheating device arranged for preheating said elongated element, said further preheating device being positioned upstream of said plurality of decorating devices.

10. Apparatus according to claim 9, wherein said further preheating device is of tubular shape so as to be able to be traversed by said elongated element.

11. Apparatus according to claim 10, wherein said further preheating device comprises an infrared-ray heating system.

12. Apparatus according to claim 1, wherein said advancing arrangement is adjustable so as to be able to receive elongated elements with transverse sections of dimensions differing from one another.

13. Apparatus according to claim 12, wherein said advancing arrangement comprises a first conveying device, a second conveying device opposite said first conveying device, a third conveying device and a fourth conveying device opposite said third conveying device.

14. Apparatus according to claim 13, wherein said first conveying device is arranged so as to define a first side support plane for a first surface of said elongated element, said second conveying device is arranged so as to define a second side support plane for a second surface of said elongated element, said fourth conveying device is arranged so as to define a third support plane for a fourth surface of said elongated element and said third conveying device is arranged so as to lean on a third surface of said elongated element.

15. Apparatus according to claim 1, wherein said plurality of decorating devices comprises a first decorating device so configured as to decorate a first side surface of said elongated element.

16. Apparatus according to claim 15, wherein said plurality of decorating devices comprises a second decorating device so configured as to decorate a second side surface of said elongated element.

17. Apparatus according to claim 16, wherein said plurality of decorating devices comprises a third decorating device so configured as to decorate an upper surface of said elongated element.

18. Apparatus according to claim 17, wherein said plurality of decorating devices comprises a fourth decorating device so configured as to decorate a lower surface of said elongated element.

* * * * *